US006012253A

United States Patent [19]

Burns

[11] Patent Number: 6,012,253

[45] Date of Patent: Jan. 11, 2000

[54] PORTABLE ENCLOSURE FOR SMALL VEHICLES

[76] Inventor: Peter R. Burns, 16 Fog Plain Rd., Waterford, Conn. 06385

[21] Appl. No.: 09/036,626

[22] Filed: Mar. 7, 1998

[51] Int. Cl.[7] ..... E04B 1/343; B65D 6/24

[52] U.S. Cl. ..... 52/79.5; 52/DIG. 14; 220/4.34

[58] Field of Search ..... 220/4.28, 4.31, 220/4.32, 4.33, 4.34; 52/DIG. 14, 79.1, 79.5, 270; 312/263, 265.5

[56] References Cited

U.S. PATENT DOCUMENTS

| | | | |
|---|---|---|---|
| D. 295,163 | 4/1988 | Erdman | D12/158 |
| 2,742,674 | 4/1956 | Melder | 20/1.13 |
| 3,348,713 | 10/1967 | Will | 214/450 |
| 3,371,816 | 3/1968 | Ricci | 220/4.28 |
| 3,566,554 | 3/1971 | Schaffer et al. | 52/79.5 |
| 3,912,098 | 10/1975 | Nicotra | 214/450 |
| 4,637,179 | 1/1987 | Rigelow, Jr. et al. | 52/79.5 |
| 4,921,152 | 5/1990 | Kemming | 224/42.42 |
| 5,439,149 | 8/1995 | Walter et al. | 224/32 R |
| 5,555,980 | 9/1996 | Johnston et al. | 220/4.28 |
| 5,791,098 | 8/1998 | Thomas | 220/4.28 |

FOREIGN PATENT DOCUMENTS

| | | | |
|---|---|---|---|
| 2453245 | 12/1980 | France | 52/DIG. 14 |
| 185078 | 9/1936 | Switzerland | 52/DIG. 14 |
| 238101 | 10/1945 | Switzerland | 52/DIG. 14 |

*Primary Examiner*—Michael Safavi
*Attorney, Agent, or Firm*—Albert W. Hilburger

[57] ABSTRACT

A portable protective enclosure for small vehicles comprises a plurality of individual planar panel members including a base panel, a roof panel, a front panel, a rear panel, a left side panel, and a right side panel and mutually engaging attachment devices for releasably joining the individual panel members into an integrated assembled structure. The base panel and the roof panel lie in parallel spaced apart planes, likewise the front panel and the rear panel, and the left side panel and the right side panel, and all serve for selectively enveloping a small vehicle therein. Both the roof panel and the base panel include a continuous attachment groove spaced from their peripheral edges in what is to become their interior surfaces. Each of the front panel, the rear panel, the left side panel and the right side panel includes an upper edge and a lower edge and a projecting tongue extending the length of the upper and lower edges and each of the projecting tongues is engaged with an associated one of the attachment grooves when the panels form the integrated assembled structure. Additionally, the left side and right side panels each has a pair of upright slots spaced from their upright terminal and the upright edges of the front and rear panels are engaged with those upright slots, respectively, when the panels comprise said integrated assembled structure. Structure and devices internal to the system are provided for securing the small vehicle inside the portable protective enclosure.

16 Claims, 3 Drawing Sheets

PORTABLE ENCLOSURE FOR SMALL VEHICLES

BACKGROUND OF THE INVENTION

1. Field of the Invention

The present invention relates generally to portable enclosures for small personal vehicles and, more particularly, to such enclosures which are compact, of simplified construction, and readily assembled and disassembled.

2. Description of the Prior Art

When a motorcycle or other small personal vehicle is parked outside without the protection of a garage, it is susceptible to a number of harmful conditions. This may include exposure to rain storms, dust, bird droppings, tree sap, salt sprays, hail, and ultraviolet rays of the sun. Not only can these natural elements detract from the appearance of the motorcycle, but they can accelerate aging and deterioration of rubber, vinyl, paint, and leather components. Weather damage can lower the value of the cycle and may cost the owner hundreds of dollars to have professionally repaired. This problem has previously been recognized and various constructions are known for housing and transporting small personal vehicles which may be motorized, such as all terrain vehicles, motorbikes, motorcycles, snow mobiles, and personal watercraft. A number of examples, as represented in the prior art, will now be described.

In U.S. Pat. No. 5,439,149 issued Aug. 8, 1995 to Walter et al., a storage case for a motorcycle is disclosed which can be fixed on the motorcycle frame and includes a basic housing, a carrying handle, a lid hinged to the housing, and a device for fixing the case on the motorcycle frame and/or a device for locking the lid with the basic housing.

U.S. Pat. No. 4,921,152 issued May 1, 1990 to Kemming discloses an apparatus for securing a motorcycle within the cargo area of a pick-up truck which also provides lockable cabinet-type storage space. The apparatus includes a pair of spaced apart storage compartments, the space between the compartments serving as a receiving zone for the front wheel of the motorcycle. A removable securing shaft passes through the spokes of the wheel and engages threaded fasteners disposed within each compartment. Also, each compartment has a lockable lid which prevents unauthorized access to the interior of the compartment and the threaded fasteners.

U.S. Pat. No. 3,912,098 issued Oct. 14, 1975 to Nicotra discloses a carrier assembly for supporting a smaller vehicle, such as a motorcycle, motor bicycle or scooter, snowmobile, or even luggage compartment on the rear end of a larger motor vehicle such as a station wagon, camper truck, or the like. The carrier assembly is mounted on a single hitch or receptacle conventionally used on campers and similar vehicles for towing trailers. The assembly comprises a pivotally mounted platform on which the motorcycle is mounted by attaching a ramp on one end. When reversed and pivotally secured to the platform, the ramp serves as an adjustable stop element for supporting different lengths of motorcycles.

U.S. Pat. No. 3,348,713 issued Oct. 24, 1967 to Will discloses a cycle carrier mounted at the front or rear end of a larger motor vehicle. The carrier includes a platform which supports the cycle above the ground in a horizontal position transverse to the length of the motor vehicle. The platform can be pivoted to incline in either direction to form a ramp for loading and unloading the cycle.

U.S. Pat. No. 2,742,674 issued Apr. 24, 1956 to Melder discloses a housing for an automobile or the like which conforms approximately to the size and shape of the vehicle to be housed. The door by which the vehicle enters and leaves the housing is formed by a part of the peripheral wall panel of the housing which extends from the bottom and is hinged so that the door opens upwardly. A door is provided in the side wall panel of the housing and is of a size such that the vehicle door can open into the doorway and enables the driver to enter and leave the vehicle when the hinged door is closed.

An ornamental design of a storage box for motorcycles is disclosed in U.S. Pat. No. Des. 295,163 issue Apr. 12, 1988 to Erdman.

It was with knowledge of the foregoing disclosures representative of the state of the art that the present invention was conceived and has now been reduced to practice.

SUMMARY OF THE INVENTION

The present invention relates to a portable protective enclosure for small personal vehicles. It comprises a plurality of individual planar panel members including a base panel, a roof panel, a front panel, a rear panel, a left side panel, and a right side panel and mutually engaging attachment devices for releasably joining the individual panel members into an integrated assembled structure. The base panel and the roof panel lie in parallel spaced apart planes, likewise the front panel and the rear panel, and the left side panel and the right side panel, and all serve for selectively enveloping a small personal vehicle therein. Both the roof panel and the base panel include a continuous attachment groove spaced from their peripheral edges in what is to become their interior surfaces. Each of the front panel, the real panel, the left side panel and the right side panel includes an upper edge and a lower edge and a projecting tongue extending the length of the upper and lower edges and each of the projecting tongues is engaged with an associated one of the attachment grooves when the panels form the integrated assembled structure. Additionally, the left side and right side panels each has a pair of upright slots spaced from their upright terminal and the upright edges of the front and rear panels are engaged with those upright slots, respectively, when the panels comprise the integrated assembled structure. Structure and devices internal to the system are provided for securing the small personal vehicle inside the portable protective enclosure.

In another manner of speaking, the concept of the invention is to provide a daily storage shed for a motorcycle or other small vehicle that must be parked outside. The sturdy, preferably plastic, enclosure would protect the motorcycle from bright sunlight, rain, windblown dust, tree sap, bird droppings, and hail. This would help preserve the condition of the motorcycle and keep it clean for the owner. The enclosure could also be used for long-term motorcycle storage or as a motorcycle shipping container. It could be easily adapted for storage of all terrain vehicles, personal watercraft, and snow mobiles.

The rectangular enclosure of the invention might measure, for example, approximately 4 feet tall, 6 feet long, and 4 feet wide. It is comprised primarily of a bottom panel, four wall panels, and top panel. The bottom panel would support the motorcycle as it rests within the enclosure. A wheel well would be included at the front center for holding the front wheel of the motorcycle. On both sides of the wheel well would be slots for holding wheel blocks. These pin-connected, sturdy plastic blocks would stabilize the front motorcycle wheel.

A plurality of laterally extending recesses in the bottom panel assembly would be included to hold a center stand support of the motorcycle. Around the upper perimeter of the panel would be a weather-sealing groove designed to keep moisture out of the enclosure. Connector blocks would also be included near the edges to hold the bottom panel to the wall panels.

The left and right side wall panels of the invention would have vertical slots on the inner ends so the front and rear wall panels can be engaged.

The rectangular frame would rest down into the ring groove in the bottom panel assembly. Included at the inside of the left and right side wall panels would be channels for a stabilizing bar. This would help keep the motorcycle from shifting side-to-side while in transit. The back panel might be provided with a plurality of horizontal vents that slant downward to prevent rain entry while maintaining air circulation. The top of the enclosure might he provided with a molded-in bubble to accommodate the windshield and fairing of the motorcycle.

Once the enclosure is assembled around the motorcycle, the motorcycle would be protected against rain, bright sunlight, and other elements. The invention could be used for short- or long-term storage of the machine, as well as for shipping. The design would even make the enclosure stackable, if desired. In addition to motorcycle applications, a special bottom panel assembly would be available for owners of all terrain vehicles, personal watercraft, and snow mobiles.

The invention herein disclosed would thus fulfill the need for a durable all-weather enclosure for motorcycles and other small personal vehicles. The appealing features of the invention reside in its ease of use, the protection provided, and ability to preserve the condition of the vehicle. Instead of leaving a motorcycle or other small personal vehicle left outside exposed to changing weather conditions, this protective enclosure would be used. The invention would shield the vehicle from the bright sunlight, rain, dust, hail, and possible scratches. This would help protect personal property and keep the motorcycle looking like new. It would also reduce the frequency with which the vehicle must be washed.

Additionally, the potential exists for varying the production of the invention in ways which could make it more appealing to a wider range of end users. This might include producing the enclosure in different sizes to accommodate motorcycles ranging from dirt bikes to touring cycles. Different colors such as white, green, yellow, and camouflage could even be made available for owners of these vehicles. Models may also be considered for all-terrain vehicles, snowmobiles, and personal watercraft.

The invention lends itself to being produced easily using conventional and readily available materials and manufacturing processes. No new production technology would be required. It could be produced from plastics such as polypropylene, ABS, or high-density polythylene. These materials, which are readily available in a variety of colors, are reasonably priced and easily formed by a wide range of plastic processors. Injection molding might be a standard approach to production.

A primary feature, then of the invention is to provide a portable enclosure for small personal vehicles and, more particularly, to such enclosures which are compact, of simplified construction, and readily assembled and disassembled.

Another feature of the invention is to provide such a portable enclosure which enables the vehicle to be easily and quickly placed into and removed from its interior.

A further feature of the invention is to provide such a portable enclosure which is light in weight and can be inexpensively produced and maintained.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

DETAILED DESCRIPTION OF THE PREFERRED EMBODIMENTS

Figure 1:
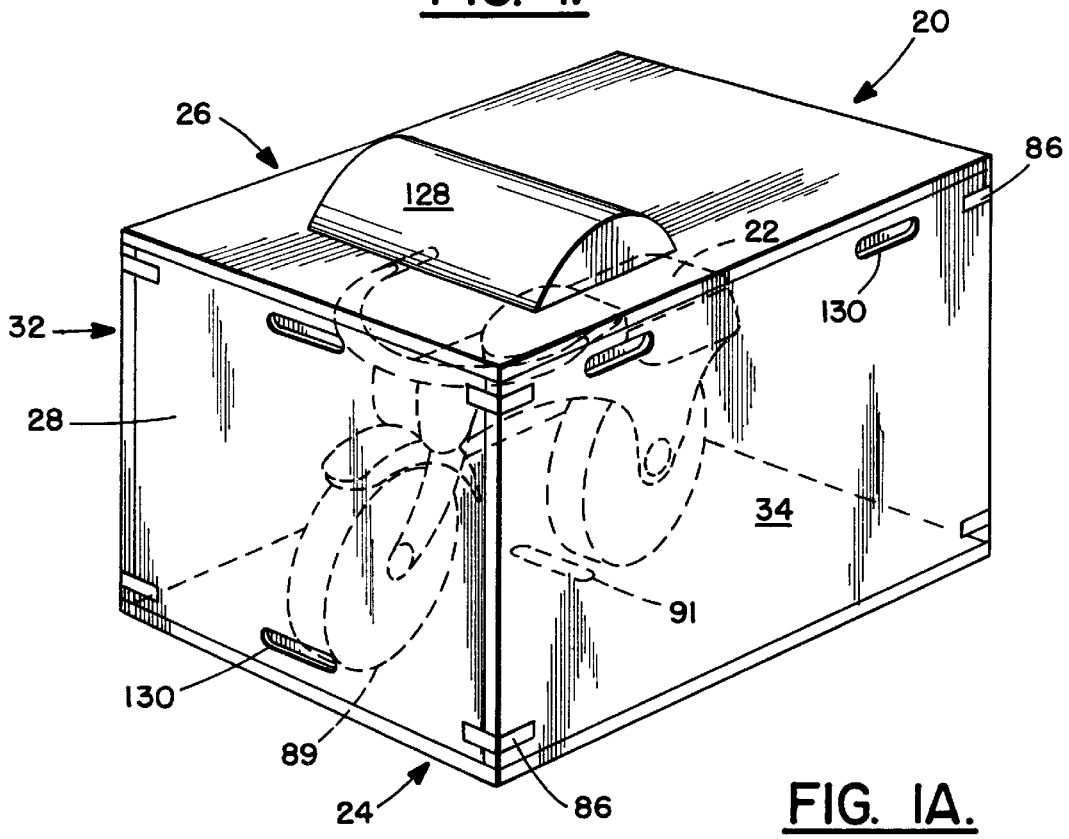
FIG. 1 is a perspective view of an assembled enclosure embodying the invention and protectively enveloping a motorcycle.
Figure 2:
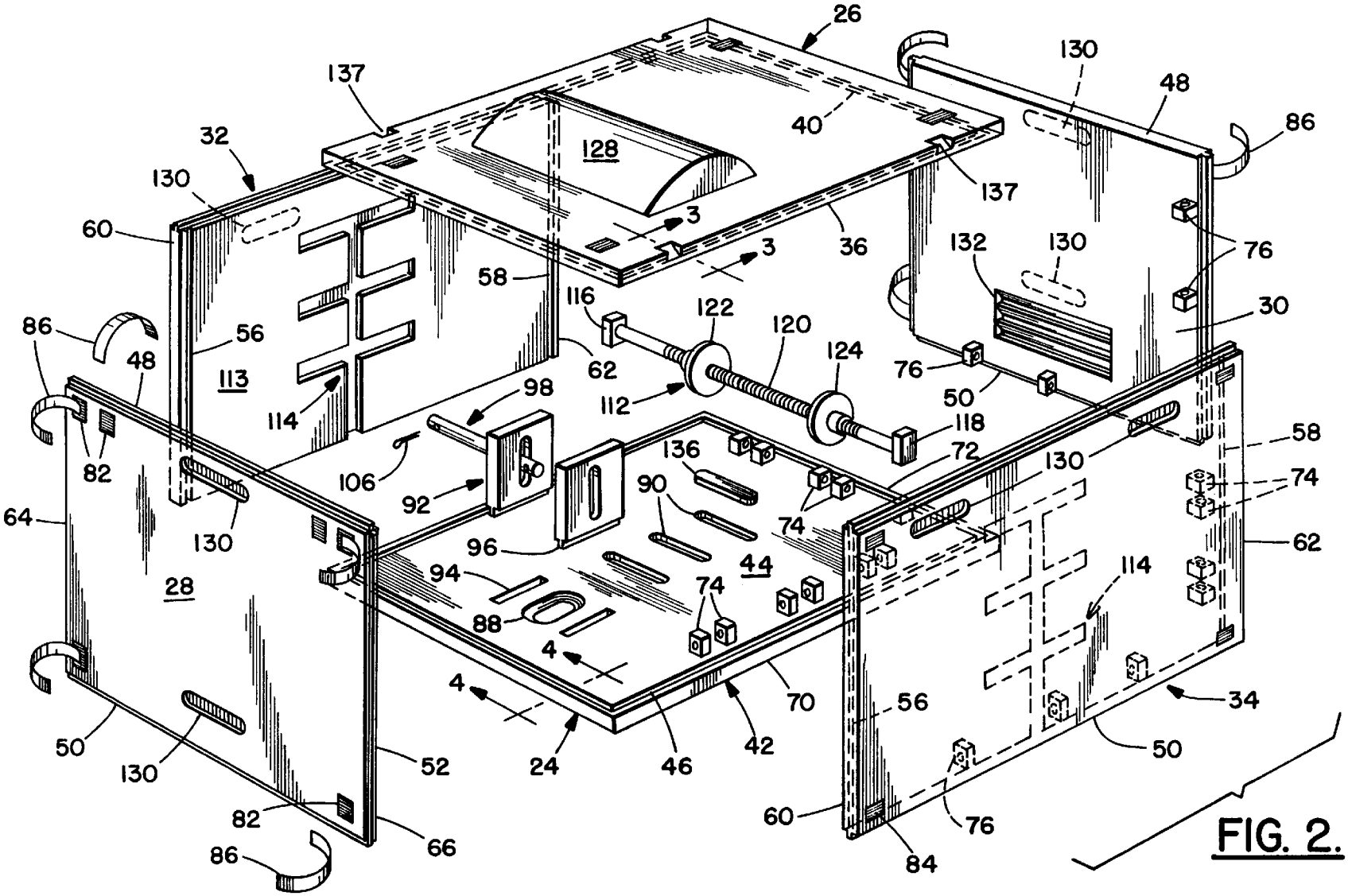
FIG. 2 is a perspective exploded view of the enclosure of FIG. 1.

Turn now to the drawings and, initially, to FIGS. 1 and 2 which generally illustrate a portable protective enclosure 20 for small personal vehicles 22 such as a motorcycle. However, it will be understood that the invention may just as likely be used for the storage of all terrain vehicles, motorbikes, snow mobiles, personal watercraft or other such small personal vehicles.

The enclosure 20 may actually be provided in a kit form ready for assembly or it may be provided already assembled. In either event, it is comprised of a plurality of individual planar panel members which include a base panel 24, a roof panel 26, a front panel 28, a rear panel 30, a left side panel 32, and a right side panel 34. Mutually engaging attachment devices are provided for releasably joining the individual panel members into an integrated assembled structure as illustrated in FIG. 1. In this condition, the base panel 24 and the roof panel 26 are generally coextensive and lie in parallel spaced apart planes, the front panel 28 and the rear panel 30 are generally coextensive and lie in parallel spaced apart planes, and the left side panel 32 and the right side panel 34 are generally coextensive and lie in parallel spaced apart planes. All serve for selectively enveloping the small personal vehicle 22 within the enclosure 20.

Figure 1A:
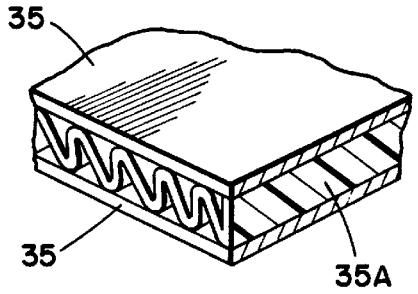
FIG. 1A is a detail perspective view illustrating one component of the invention in greater detail.

As seen in FIG. 1A, each of the panels may be of honeycomb-type construction with opposed spaced layers 35 of plastic sheet material with a structural filler 35A sandwiched therebetween and suitably bonded into a unitary construction. In this way, the resulting panels would exhibit optimum strength with minimum weight.

Figure 4:
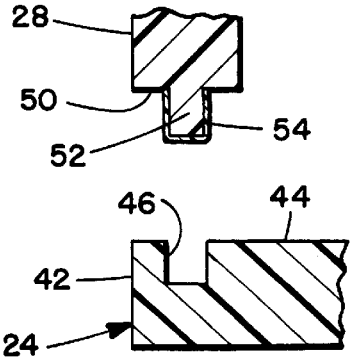
FIG. 4 is a detail cross section view taken generally along line 4—4 in FIG. 2.
Figure 3:
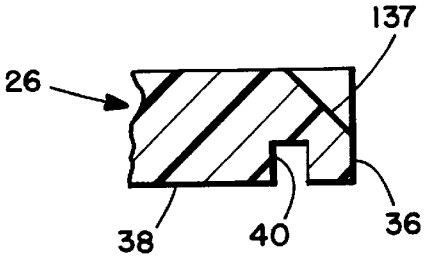
FIG. 3 is a detail cross section view taken generally along line 3—3 in FIG. 2.

Turning to FIG. 3, the roof panel 26 includes a peripheral edge 36 and a ceiling surface 38 and has a continuous attachment groove 40 in the ceiling surface spaced from the peripheral edge. Similarly, viewing FIG. 4, the base panel 24 includes a peripheral edge 42 and a floor surface 44 and has an attachment groove 46 in the floor surface spaced from the peripheral edge.

Continuing to view FIG. 2, the front panel 28 includes an upper edge 48 and a lower edge 50 and each is preferably formed with a projecting tongue 52 (see especially FIG. 4) extending the length of the upper and lower edges, respectively. In a similar fashion, the rear panel 30, the left side panel 32 and the right side panel 34 have upper and lower edges 48, 50 with projecting tongues 52 extending the lengths of the upper and lower edges, respectively. In each instance, the projecting tongues 52 are engaged with an associated one of the attachment grooves 46 when the panels comprise the integrated assembled structure as seen in FIG. 1. Preferably, a suitable sealing construction 54 (FIG. 4) such as a vinyl or rubberlike coating or the like on the projecting tongues 52 of each of the panels is provided for a fitting sealing engagement with the attachment grooves 40, 46 of the roof and base panels, 26, 24, respectively.

Continuing with reference to FIG. 2, the left side panel 32 and the right side panel 34 are both formed with a pair of upright slots 56, 58 spaced from their upright terminal edges 60, 62, respectively. In turn, projecting tongues 52 of upright edges 64, 66 of the front panel 28 and of the rear panel 30, respectively, are engaged with the upright slots 56, 58 when the panels assume the integrated assembled structure. As in the instance of the projecting tongues 52 previously described, the projecting tongues of upright terminal edges 64, 66 are preferably provided with the sealing construction 54 for sealing engagement with the upright slots 56, 58.

It was earlier mentioned that mutually engaging attachment devices are provided for releasably joining the individual panel members into an integrated assembled structure. These attachment devices will now be described.

The peripheral edge 42 of the base panel 24 includes a right side edge 70 and a rear edge 72 adjoining the right side edge. A plurality of spaced pairs of first block members 74 are integral with the base panel at longitudinally spaced locations and spaced from the right side edge 70. Another plurality of spaced pairs of the first block members 74 are integral with the base panel at laterally spaced locations and spaced from the rear edge 72. A plurality of second block members 76 are integral with the right side panel 34 adjacent the lower edge 50 positioned for fitting reception between the spaced pairs of the first block members 74.

Figure 5:
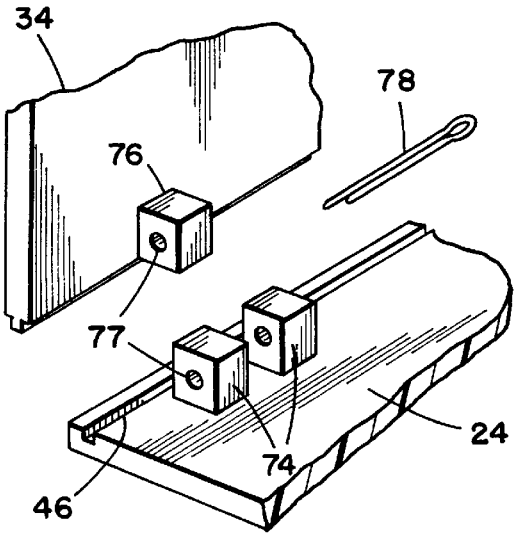
FIG. 5 is a detail perspective view, exploded, illustrating in greater detail components of the invention about to be assembled.

Similarly, a plurality of second block members 76 integral with the rear panel 30 adjacent the lower edge 50 are positioned for fitting reception between the spaced pairs of the first block members 74 near the rear edge 72 of the base panel. Still another plurality of the spaced pairs of first block members 74 are integral with the right side panel 34 adjacent the upright edge 60 at a plurality of elevationally spaced locations. Finally, a plurality of second block members 76 integral with the rear panel 30 adjacent the upright edge 62 are positioned for fitting reception between the spaced pairs of the first block members. To secure the resulting structure so the block members 74, 76 remain engaged, they are suitably drilled as indicated by drill bores 77 in more detail in FIG. 5 and a cotter pin 78 inserted and spread to a locking condition for releasably joining each pair of the first block members with an associated one of the second block members. Of course, various other suitable fastening arrangements may be employed.

In order to immobilize adjoining panels in their erected condition, selectively releasable closure devices 80 are provided adjacent the upright edges of the front panel, the rear panel, the left side panel and the right side panel. Each of these closure devices may be in the nature of spaced pads 82, 84 of hook and loop material spaced from the upright edges and strips 86 having a surface of the opposite type of hook or loop material removably overlying the upright edges and impressed upon the pads. Two or more of these closure devices are preferably provided at spaced locations along the upright edges to effectively assure immobility between each pair of adjoining panels. Such closure devices may also be employed to secure the side panels 28, 30, 32, and 34 to the roof panel 26.

The base panel 24 includes a wheel well 88 formed into the floor surface in a contoured manner for receiving a front wheel 89 of the motorcycle 22 and also includes one or more laterally extending recesses 90 at longitudinally spaced locations aligned with the center of the wheel well for receiving a center stand 91 of the motorcycle. A pair of laterally spaced wheel block members 92 have undersurfaces suitably contoured for mounting on the floor surface 44 for the reception therebetween of the front wheel of the motorcycle. A pair of laterally spaced mounting slots 94 are formed in the floor surface 44 and the undersurface of each of the wheel block members 92 includes a longitudinally extending mounting tongue 96. The mounting tongue 96 of each wheel block member is engageably received with an associated mounting slot and suitable adhesive is applied to the mating surfaces for fixedly mounting the undersurface of each of the wheel block members to the wheel well.

Figure 6:
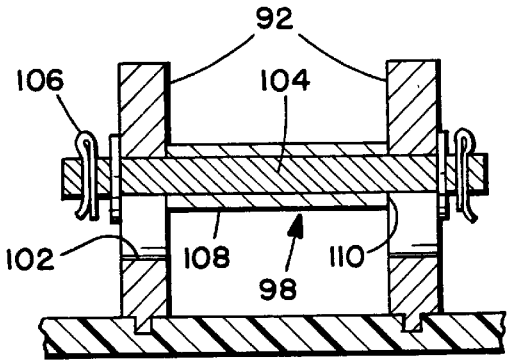
FIG. 6 is a detail elevational view, in section, of still other assembled components of the invention.

A support bar device 98 extends through the spokes of the front wheel 89 of the motorcycle 22 and is releasably mounted at its opposite ends to the wheel block members 92, respectively. More specifically, viewing FIG. 6, the wheel block members have an associated pair of laterally aligned through bores 102 and the support bar device includes a support rod 104 which extends through the bores with suitable fasteners such as cotter pins 106 being received on the ends of the support rod for retaining the support rod on the wheel block members with the further aid of retainer washers 107. The support bar device 98 further includes a support tube 108 which is slidably received on the support rod and has an outer diameter larger than the diameter of the aligned through bores 102 in the wheel block members 92. The support tube has opposed ends 110 engaged with the wheel block members when the fasteners 106 are in a tightened condition.

Figure 7:
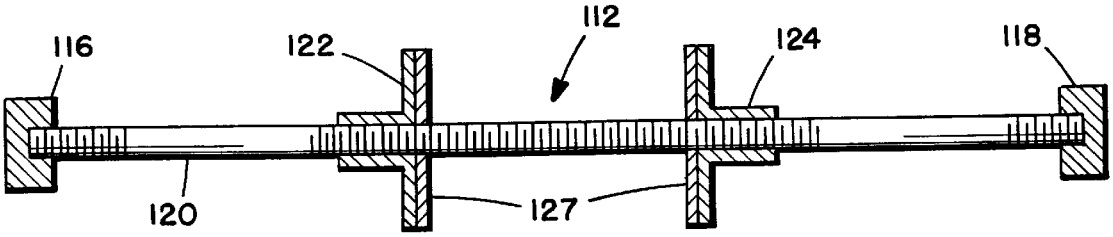
FIG. 7 is a detail elevational view, partly in section, of yet other assembled components of the invention.

The system of the invention further includes stabilizing apparatus 112, as seen in FIGS. 2 and 7, which is selectively engageable with the body of the motorcycle 22 for holding it upright within the portable protective enclosure 20. To this end, each of the left side and right side panels 32, 34 has an inner surface 113, and a shaped channel system 114 formed in each inner surface. Opposed stabilizer blocks 116, 118 are in slidable engagement, respectively, with the shaped channel system 114 in the left side panel 32 and in the right side panel 34. A stabilizer rod 120 extends across the motorcycle 22 between left and right ends which are fixed to the first and second stabilizer blocks, respectively. The stabilizers rod 120 is threaded along its length between the stabilizer block 116 and the stabilizer block 118. With this construction, a pair of stabilizer pads 122, 124 each with central threaded bores 126 are threadedly engaged with the stabilizer rod for movement, as they are rotated, respectively, about a longitudinal axis of the stabilizer rod between a retracted position distant from the motorcycle and an advanced position engaged with the motorcycle. The surfaces of the stabilizer pads which engage the outer surfaces of the motorcycle may be provided with a soft or deformable material 127 so as not to damage the motorcycle when they are tightened down.

Figure 8:
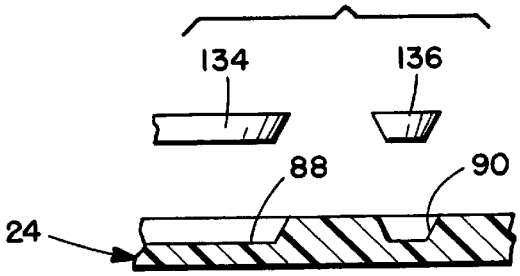
FIG. 8 is a detail elevational exploded view of still other components of the invention.

As seen in FIG. 2, a bubble-like projection 128 may be formed in the roof panel 26 sized, shaped, and positioned to accommodate the windshield of the motorcycle when located within the portable protective enclosure 20. Also, the front panel 28, rear panel 30, and left and right side panels 32, 34, respectively, include recessed hand holds 130 for lifting and carrying the portable protective enclosure 20. Further, a suitable downwardly slanted vent structure 132 may be provided in one or more of the panels (here illustrated in the rear panel 30) for preventing the entry of precipitation while providing air circulation within the portable protective enclosure. As seen in FIG. 8, it may also be desirable to provide a properly sized and shaped wheel well plug 134 for filling the wheel well 88 when not in use so as to he flush with the floor surface 44 of the base panel 24. In a similar manner, It may also be desirable to provide a properly sized and shaped recess plug 136 for filling each of the laterally extending recesses 90 when they are not in use.

Suitable grooves 137 may also be provided at longitudinally spaced locations along the peripheral edge of the roof panel. These grooves would serve to receive tie-down straps (not shown) of the type customarily available if the enclosure 20 is mounted on the bed of a pick-up truck, for example.

Figure 9:
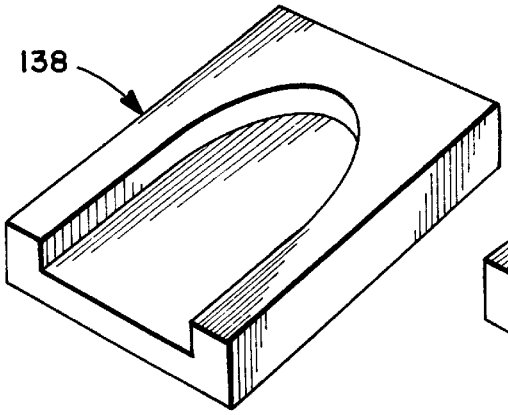
FIG. 9 is a detail perspective view of another component of choice for use with the enclosure of the invention.
Figure 10:
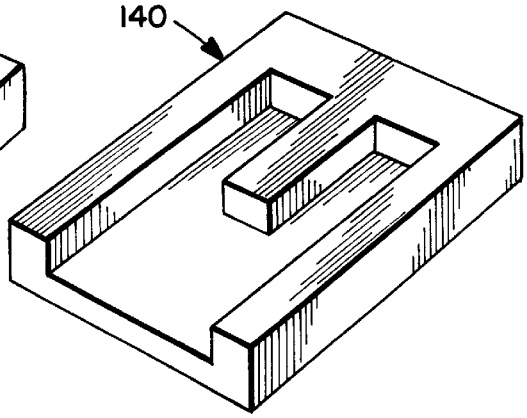
FIG. 10 is a detail perspective view of still another component of choice for use with the enclosure of the invention.

It may be desirable to provide an insert of suitable material for removable place overlying the base panel 24 and including an upper surface contoured the supportive reception thereon of a small vehicle other than a motorcycle. As seen in FIG. 9, for example, an insert 138 may be provided to accommodate a personal watercraft while, as seen in FIG. 10, an insert 140 may be provided to accommodate a snow mobile. Before such an insert 138 or 140 is put into place, it would be desirable to apply the wheel well plug 134 to the wheel well 88 and the recess plugs 136 to each of the laterally extending recesses 90.

It was in an effort to provide an effective means of protecting from possible harm while parked outside a motorcycle or other small personal vehicle, that the present invention was conceived. As has been described, the protective enclosure of the invention could be assembled from a set of strong plastic panels that are pieced together. The enclosure thereby created would include a front wheel well, wheel blocks, vents, and stabilizer bar. The design would support, conceal, and protect the motorcycle when it is not being used by the owner.

The durable weatherproof enclosure would protect the motorcycle against the natural elements while parked outside. Once entered and secured, the enclosure would block out moisture, hail, dust, sunlight, and other potentially harmful elements. The motorcycle could be stored short-term or long-term in this state, and could even be shipped in the container. If desired, multiple sheds could be stacked atop one another for storing or shipping multiple motorcycles or other small personal vehicles.

The invention could be used to protect the motorcycle's painted finish by intercepting direct sunlight. This is especially important for the upper portion of the gasoline tank, which tends to fade first from sunlight exposure. Likewise, sunlight protection would help keep the black seat of the motorcycle cool. This would make the seat more comfortable to mount on a hot summer day and prevent the rider from being burned.

In the case of a hailstorm, the plastic enclosure would help prevent small nicks and chips in the paint. The sturdy enclosure would also serve to protect rubber, vinyl, or leather components from the fade and oxidation caused by ultraviolet rays, wind-blown dust, pollutants, and smog. Tree sap and bird dropping could also be intercepted before hitting the bike's surface. This would reduce the frequency with which the motorcycle must be washed by the owner.

Another benefit of using the enclosure of the invention would be the possibility of retaining the value of the motorcycle. Since the vehicle would be protected against harmful sun rays, acid rain, and other damaging elements, the paint and trim could maintain the original finish and shine longer. Rust, faded paint, and cracked seating can quickly depreciate the value of a motorcycle.

Using the enclosure of the invention on a regular basis could pay for itself many times over when it comes time to sell the bike. Of course, the owner could also enjoy the motorcycle's clean, blemish-free finish for years before ever trading it in or purchasing another vehicle.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A portable protective enclosure for small vehicles such as a motorcycle comprising:

a plurality of individual planar panel members including a base panel, a roof panel, a front panel, a rear panel, a left side panel, and a right side panel; and mutually engaging attachment means for releasably joining said individual panel members into an integrated assembled structure wherein said base panel and said roof panel are generally coextensive and lie in parallel spaced apart planes, wherein said front panel and said rear panel are generally coextensive and lie in parallel spaced apart planes, and wherein said left side panel and said right side panel are generally coextensive and lie in parallel spaced apart planes, all for selectively enveloping a small vehicle therein;

wherein said peripheral edge of said base panel includes a right side edge and a rear edge adjoining said right side edge;

wherein said attachment means includes:

a plurality of spaced pairs of first block members integral with said base panel at longitudinally spaced locations and spaced from said right side edge;

a plurality of spaced pairs of first block members integral with said base panel at laterally spaced locations and spaced from said rear edge;

a plurality of second block members integral with said right side panel adjacent said lower edge positioned for fitting reception between said spaced pairs of said first block members integral with said base panel near said right side edge;

a plurality of second block members integral with said rear panel adjacent said lower edge positioned for fitting reception between said spaced pairs of said first block members integral with said base panel near said rear edge;

a plurality of spaced pairs of first block members integral with said right side panel adjacent said upright edge at a plurality of elevationally spaced locations;

a plurality of second block members integral with said rear panel adjacent said upright edge positioned for fitting reception between said spaced pairs of said first block members integral with said right side panel; and fastener means for releasably joining each pair of said first block members with an associated one of said second block members.

2. A portable protective enclosure as set forth in claim 1 wherein said roof panel includes a peripheral edge and a ceiling surface and has an attachment groove in said ceiling surface spaced from said peripheral edge;

wherein said base panel includes a peripheral edge and a floor surface and has an attachment groove in said floor surface spaced from said peripheral edge;

wherein each of said front panel, said rear panel, said left side panel and said right side panel includes an upper edge and a lower edge and a projecting tongue extending the length of said upper edge and said lower edge; and wherein each of said projecting tongues is engaged with an associated one of said attachment grooves when said panels comprise said integrated assembled structure.

3. A portable protective enclosure as set forth in claim 2 wherein each of said front panel, said rear panel, said left side panel and said right side panel includes a pair of upright parallel spaced apart edges;

wherein said left side panel and said right side panel each has a pair of upright slots spaced from said upright edges, respectively; and wherein said upright edges of said front panel and of said rear panel are engaged with the upright slots of said left side panel and of said right side panel, respectively, when said panels comprise said integrated assembled structure.

4. A portable protective enclosure as set forth in claim 3 including:

sealing means on said projecting tongue of each of said front panel, said rear panel, said left side panel and said right side panel for sealing engagement with the attachment grooves of said roof and base panels, respectively.

5. A portable protective enclosure as set forth in claim 3 including:

sealing means on said upright parallel spaced apart edges of each of said front panel and said rear panel for sealing engagement with the upright slots of said left side panel and of said right side panel, respectively.

6. A portable protective enclosure as set forth in claim 1 including:

selectively releasable closure means adjacent ones of said upright edges of said front panel, said rear panel, said left side panel and said right side panel for immobilizing adjoining ones of said panels.

7. A portable protective enclosure as set forth in claim 1 including:

stabilizing means selectively engageable with the body of the motorcycle for holding it upright within said portable protective enclosure.

8. A portable protective enclosure as set forth in claim 1 wherein each of said front panel, said rear panel, said left side panel and said right side panel includes an outer surface with recessed hand holds therein for lifting and carrying said portable protective enclosure.

9. A portable protective enclosure as set forth in claim 1 wherein at least one of said front panel, said rear panel, said left side panel and said right side panel includes vent means for providing air circulation within said portable protective enclosure.

10. A portable protective enclosure as set forth in claim 1 wherein said base panel includes a wheel well formed therein for receiving the front wheel of a motorcycle and at least one laterally extending recess for receiving the center stand of the motorcycle; and a wheel well plug for filling said wheel well when not in use so as to be flush with said floor Surface of said base panel; and a recess plug for filling each of said laterally extending recesses.

11. A portable protective enclosure as set forth in claim 1 including:

insert means for removable placement overlying said base panel, said insert means including an upper surface contoured for the supportive reception thereon of a small vehicle other than a motorcycle.

12. A portable protective enclosure for small vehicles comprising:

a plurality of individual planar panel members including a base panel, a roof panel, a front panel, a rear panel, a left side panel, and a right side panel, said base panel including a wheel well formed therein for receiving the front wheel of a motorcycle and a laterally extending recess for receiving the center stand of the motorcycle;

mutually engaging attachment means for releasably joining said individual panel members into an integrated assembled structure wherein said base panel and said roof panel are generally coextensive and lie in parallel spaced apart planes, wherein said front panel and said rear panel are generally coextensive and lie in parallel spaced apart planes, and wherein said left side panel and said right side panel are generally coextensive and lie in parallel spaced apart planes, all for selectively enveloping a small vehicle therein;

a pair of laterally spaced wheel block members mounted in said wheel well for reception therebetween of the motorcycle; and support bar means extending through the front wheel of the motorcycle and releasably mounted at its opposite ends to said wheel block members, respectively.

13. A portable protective enclosure as set forth in claim 12 wherein said wheel block members have a pair of laterally aligned through bores;

wherein said support bar means includes a support rod extending through the pair of laterally aligned through bores and fasteners for retaining said support rod on said wheel block members; and including:

a support tube slidably received on said support rod having an outer diameter larger than the diameter of the aligned through bores in said wheel block members, said support tube having opposed ends engaged with said wheel block members when said fasteners are in a tightened condition.

14. A portable protective enclosure as set forth in claim 12 wherein said wheel well has a pair of laterally spaced mounting slots therein; and wherein each of said wheel block members includes an undersurface and a longitudinally extending mounting tongue on said undersurface, said mounting tongue being engageably receivable with the mounting slots in said slots in said wheel well; and adhesive means for fixedly mounting said undersurface of each of said wheel block members to said wheel well.

15. A portable protective enclosure as set forth in claim 11 wherein each of said left side panels and said right side panels has an inner surface and a shaped channel system formed in said inner surface;

wherein said stabilizing means includes:

first and second stabilizer blocks for slidable engagement, respectively, with said shaped channel system in said left side panel and in said right side panel;

a stabilizer rod extending across the motorcycle between left and right ends and fixed to said first and second stabilizer blocks, respectively, said stabilizer rod having left hand threads thereon between a center region thereof and said first stabilizer block, said stabilizer rod having right hand threads thereon between a center region thereof and said second stabilizer block;

a first stabilizer pad threadedly engaged with said left hand threads of said stabilizer rod for movement between a retracted position distant from the motorcycle and an advanced position engaged with the motorcycle; and a second stabilizer pad threadedly engaged with said right hand threads of said stabilizer rod for movement between a retracted position distant from the motorcycle and an advanced position engaged with the motorcycle, said first and second stabilizer pads being movable between said first and second positions.

16. A portable protective enclosure for small vehicles such as a motorcycle comprising:

a plurality of individual planar panel members including a base panel, a roof panel, a front panel, a rear panel, a left side panel, and a right side panel;

mutually engaging attachment means for releasably joining said individual panel members into an integrated assembled structure wherein said base panel and said roof panel are generally coextensive and lie in parallel spaced apart planes, wherein said front panel and said rear panel are generally coextensive and lie in parallel spaced apart planes, and wherein said left side panel and said right side panel are generally coextensive and lie in parallel spaced apart planes, all for selectively enveloping a small vehicle therein; and a bubble-like projection in said roof panel sized and positioned to accommodate the windshield of the motorcycle when located within said portable protective enclosure.

* * * * *